US012655509B2

(12) United States Patent
Hatano et al.

(10) Patent No.: US 12,655,509 B2
(45) Date of Patent: Jun. 16, 2026

(54) AUSTENITIC STAINLESS STEEL MATERIAL, METHOD FOR PRODUCING THE SAME, AND DEVICE FOR HYDROGEN

(71) Applicant: NIPPON STEEL STAINLESS STEEL CORPORATION, Tokyo (JP)

(72) Inventors: Masaharu Hatano, Tokyo (JP); Mitsuki Matsumoto, Tokyo (JP); Manami Ikado, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 413 days.

(21) Appl. No.: 18/562,977

(22) PCT Filed: Jun. 2, 2022

(86) PCT No.: PCT/JP2022/022428
§ 371 (c)(1),
(2) Date: Nov. 21, 2023

(87) PCT Pub. No.: WO2022/255437
PCT Pub. Date: Dec. 8, 2022

(65) Prior Publication Data

US 2024/0209486 A1 Jun. 27, 2024

(30) Foreign Application Priority Data

Jun. 3, 2021 (JP) ..... 2021-093363

(51) Int. Cl.

| | |
|---|---|
| ***C22C 38/58*** | (2006.01) |
| ***C21D 6/04*** | (2006.01) |
| ***C21D 7/02*** | (2006.01) |
| ***C22C 38/00*** | (2006.01) |
| ***C22C 38/02*** | (2006.01) |
| ***C22C 38/42*** | (2006.01) |
| ***C22C 38/44*** | (2006.01) |

(52) U.S. Cl.
CPC ..... *C22C 38/58* (2013.01); *C21D 6/04* (2013.01); *C21D 7/02* (2013.01); *C22C 38/001* (2013.01); *C22C 38/02* (2013.01); *C22C 38/42* (2013.01); *C22C 38/44* (2013.01); *C21D 2211/001* (2013.01)

(58) Field of Classification Search
CPC ..... C21D 6/004; C21D 6/005; C21D 6/04; C21D 2211/001; C21D 7/02; C22C 38/04; C22C 38/58
See application file for complete search history.

(56) References Cited

U.S. PATENT DOCUMENTS

| | | | | |
|---|---|---|---|---|
| 2020/0131595 | A1* | 4/2020 | Hamada | C21D 9/46 |
| 2020/0131610 | A1* | 4/2020 | Matsumoto | C22C 38/001 |

FOREIGN PATENT DOCUMENTS

| | | |
|---|---|---|
| JP | 2009-084597 | 4/2009 |
| JP | 2018-135592 | 8/2018 |
| JP | 2019-143227 | 8/2019 |
| JP | 2019-143228 | 8/2019 |

* cited by examiner

*Primary Examiner* — Vanessa T. Luk
(74) *Attorney, Agent, or Firm* — Birch, Stewart, Kolasch & Birch, LLP

(57) ABSTRACT

Provided is an austenitic stainless steel material, wherein a chemical composition includes, in mass %, C: 0.20% or less, Si: 2.0% or less, Mn: 6.0 to 20.0%, P: 0.060% or less, S: 0.0080% or less, Cr: 10.0 to 18.0%, Ni: 4.0 to 12.0%, N: 0.01 to 0.30%, Cu: 4.0% or less, Mo: 3.0% or less, an optional element, and the balance: Fe and impurity, an A value is 30.0 to 60.0, and in a metallurgical structure of a surface layer, a proportion Gs of high angle grain boundaries satisfies [0.1<Gs<0.6].

20 Claims, No Drawings

AUSTENITIC STAINLESS STEEL MATERIAL, METHOD FOR PRODUCING THE SAME, AND DEVICE FOR HYDROGEN

TECHNICAL FIELD

The present disclosure relates to an austenitic stainless steel material, a method for producing the same, and a device for hydrogen.

BACKGROUND ART

In recent years, hydrogen energy has been attracting attention as clean energy that does not discharge greenhouse gases, such as carbon dioxide. In utilizing hydrogen energy, there has been a demand for establishing hydrogen-related techniques, such as techniques for producing, storing, and transporting hydrogen.

However, there are various problems in the establishment of the hydrogen-related techniques. One of the problems is the problem of hydrogen embrittlement.

Hydrogen energy uses hydrogen gas as a fuel source. Therefore, for example, when a metal material is used in a relevant apparatus, such as a hydrogen production apparatus or a hydrogen storage apparatus, the problem called hydrogen embrittlement occurs in which a material is embrittled due to hydrogen gas.

From the viewpoint of manufacturing costs, strength, and corrosion resistance, austenitic stainless steel is used as one of the metal materials used for the above-mentioned relevant apparatus. To suppress hydrogen embrittlement, austenitic stainless steels having increased hydrogen embrittlement resistance have been developed.

Patent Documents 1 and 2, for example, disclose high Mn austenitic stainless steels that are excellent in hydrogen embrittlement resistance at low temperatures and in economic efficiency. In the austenitic stainless steels disclosed in Patent Documents 1 and 2, economic efficiency and hydrogen embrittlement resistance are enhanced by adjusting chemical compositions to predetermined amounts.

There may be cases in which members or parts of the above-described hydrogen relevant apparatus are used after strength is increased by performing cold working to cause work hardening. There are cases in which hydrogen embrittlement resistance of some austenitic stainless steels is lowered after cold working is performed. In view of the above, Patent Document 3 discloses a hydrogen-resistant spring stainless steel wire that has preferable hydrogen resistance even after certain cold working is performed.

In the steel wire disclosed in Patent Document 3, by adjusting a content of Cr to 18% or more and a content of N to 0.3% or more, hydrogen resistance is increased and hence, preferable hydrogen resistance is achieved even after cold working is performed. Patent Document 4 discloses a high-pressure hydrogen austenitic stainless steel that achieves high offset yield strength and high hardness in a state of solution treatment regardless of cold working. In the austenitic stainless steel disclosed in Patent Document 4, 0.40 to 1.00% of C is contained, and Cr carbides are caused to be present in an area ratio of 23% or more and hence, high strength is achieved even in the state of the solution treatment and hydrogen embrittlement resistance is also enhanced.

LIST OF PRIOR ART DOCUMENTS

Patent Documents

Patent Document 1: JP2019-143227A
Patent Document 2: JP2019-143228A

Patent Document 3: JP2009-084597A
Patent Document 4: JP2018-135592A

SUMMARY OF INVENTION

Technical Problem

However, the above-described Patent Documents 1 and 2 disclosing the austenitic stainless steels do not mention about hydrogen embrittlement resistance after cold working. Therefore, there is room for further improvement of this characteristic. In the austenitic stainless steels disclosed in Patent Documents 3 and 4, a content of Cr, a content of N, and a content of C are higher than those in general austenitic stainless steel, so that there is still room for further improvement from the viewpoint of economic efficiency and manufacturability.

Accordingly, there is a problem that it is difficult for an austenitic stainless steel material used for members, parts, or the like of a hydrogen relevant apparatus to achieve both hydrogen embrittlement resistance and economic efficiency.

An objective of the present disclosure is to solve the above-mentioned problem and to provide an austenitic stainless steel material that achieves both hydrogen embrittlement resistance and economic efficiency.

Solution to Problem

The present disclosure has been made to solve the above-mentioned problem, and the following austenitic stainless steel material is the gist of the present disclosure.

(1) An austenitic stainless steel material, wherein
a chemical composition includes, in mass %:
C: 0.20% or less;
Si: 2.0% or less;
Mn: 6.0 to 20.0%;
P: 0.060% or less;
S: 0.0080% or less;
Cr: 10.0 to 18.0%;
Ni: 4.0 to 12.0%;
N: 0.01 to 0.30%;
Cu: 4.0% or less;
Mo: 3.0% or less;
Al: 0 to 0.20%;
Ca: 0 to 0.01%;
B: 0 to 0.01%;
Mg: 0 to 0.01%;
Nb: 0 to 1.0%;
Ti: 0 to 1.0%;
V: 0 to 1.0%;
W: 0 to 2.0%;
Zr: 0 to 1.0%;
Co: 0 to 2.0%;
Ga: 0 to 0.10%;
Hf 0 to 0.10%;
REM: 0 to 0.10%; and
the balance: Fe and impurity,
an A value calculated by a formula (i) described below is 30.0 to 60.0, and
in a metallurgical structure of a surface layer, a proportion Gs of high angle grain boundaries satisfies a formula (ii) described below:

$$\text{A value}=3.2Mn+0.7Cr+6.2Ni+38.7N+4.8Cu+9.3Mo-53 \quad \text{(i)}$$

$$0.1<Gs<0.6 \quad \text{(ii)}$$

where element symbols in the formula (i) denote contents (mass %) of the elements contained in steel, 0 is given when the element is not contained, and a symbol in the formula described above is defined as follows:

Gs: proportion of high angle grain boundaries.

(2) The austenitic stainless steel material described in the above-mentioned (1), wherein Vickers hardness is 250 to 500 HV1, and a crystal structure has, in an area ratio, 97% or more of an fcc structure.

(3) The austenitic stainless steel material described in the above-mentioned (1), wherein the chemical composition contains, in mass %, one or more elements selected from Al: 0.01 to 0.20%,
Ca: 0.001 to 0.01%,
B: 0.0002 to 0.01%,
Mg: 0.0002 to 0.01%,
Nb: 0.01 to 1.0%,
Ti: 0.01 to 1.0%,
V: 0.01 to 1.0%,
W: 0.01 to 2.0%,
Zr: 0.01 to 1.0%,
Co: 0.01 to 2.0%,
Ga: 0.01 to 0.10%,
Hf: 0.01 to 0.10%, and
REM: 0.01 to 0.10%.

(4) The austenitic stainless steel material described in the above-mentioned (2), wherein the chemical composition contains, in mass %, one or more elements selected from Al: 0.01 to 0.20%,
Ca: 0.001 to 0.01%,
B: 0.0002 to 0.01%,
Mg: 0.0002 to 0.01%,
Nb: 0.01 to 1.0%,
Ti: 0.01 to 1.0%,
V: 0.01 to 1.0%,
W: 0.01 to 2.0%,
Zr: 0.01 to 1.0%,
Co: 0.01 to 2.0%,
Ga: 0.01 to 0.10%,
Hf 0.01 to 0.10%, and
REM: 0.01 to 0.10%.

(5) The austenitic stainless steel material described in the above-mentioned (1), wherein the austenitic stainless steel material is used in a high pressure hydrogen gas environment.

(6) The austenitic stainless steel material described in the above-mentioned (2), wherein the austenitic stainless steel material is used in a high pressure hydrogen gas environment.

(7) The austenitic stainless steel material described in the above-mentioned (3), wherein the austenitic stainless steel material is used in a high pressure hydrogen gas environment.

(8) The austenitic stainless steel material described in the above-mentioned (4), wherein the austenitic stainless steel material is used in a high pressure hydrogen gas environment.

(9) A method for producing the austenitic stainless steel material described in any one of the above-mentioned (1) to (8), wherein the method includes:

a step of performing solution treatment;

a step of performing sub-zero treatment; and a step of performing cold working.

(10) A device for hydrogen including the austenitic stainless steel material described in any one of the above-mentioned (1) to (8).

(11) The device for hydrogen described in the above-mentioned (10), wherein the device for hydrogen is a body of a tank, a mouthpiece of the tank, a liner, a pipe, a valve, or a heat exchanger.

Advantageous Effect of Invention

According to the present disclosure, it is possible to obtain an austenitic stainless steel material that achieves both hydrogen embrittlement resistance and economic efficiency.

DESCRIPTION OF EMBODIMENT

To obtain an austenitic stainless steel material that achieves both strength/hydrogen embrittlement resistance and economic efficiency, the inventors have studied and have obtained the following findings (a) to (d).

(a) To achieve both strength/elongation and hydrogen embrittlement resistance in a high pressure hydrogen gas environment, it is effective to cause the structure of the steel material to have an fcc structure, and to control the proportion of high angle grain boundaries. The reason the metallurgical structure of the steel material is caused to have the fcc structure, more specifically, a metallurgical structure of an austenite single phase, is that hydrogen embrittlement is likely to occur when martensite having a bcc structure is formed.

The high angle grain boundary refers to a grain boundary with a misorientation with respect to the orientation inside the crystal grain of 15 to 60°. In the case of a normal austenitic stainless steel material, a high angle grain boundary mainly forms a twin interface. By controlling deformation twins in the metallurgical structure, that is, the proportion of high angle grain boundaries, in plastic deformation caused by cold working at the time of producing the steel material, high strength is obtained due to work hardening. In addition to the above, it is also possible to enhance hydrogen embrittlement resistance. That is, even when plastic deformation occurs in a use environment, twinning deformation that uses the high angle grain boundaries as starting points occurs, so that a high angle grain boundary structure can be maintained. Accordingly, hydrogen embrittlement resistance is enhanced.

(b) To cause plastic deformation by twins, it is effective to control an A value being an index for the mode of plastic deformation in the steel material. By controlling the A value, it is possible to promote formation of high angle grain boundaries. Further, by controlling the A value, a deformation mechanism in plastic deformation is mainly twinning deformation. However, when an element, such as Ni, N, Cu, and Mo, is contained excessively, the formation of high angle grain boundaries may be suppressed. Therefore, it is effective to control the A value by increasing a content of Mn, which is excellent in economic efficiency, within a range of the chemical composition of the steel material.

(c) As a result, twinning deformation that uses the high angle grain boundaries as the starting points occurs in a use environment, so that the high angle grain boundary structure is maintained and hydrogen embrittlement resistance is also maintained. From the viewpoint of increasing strength, Vickers hardness is preferably set to 250 HV1 or more. To suppress lowering of elongation in a high-pressure hydrogen gas, that is, to ensure hydrogen embrittlement resistance, Vickers hardness is preferably set to 500 HV1 or less.

(d) To obtain the metallurgical structure described above, solution treatment and cold working performed after the solution treatment are required in a steel material production process. In order to cause work hardening by efficiently introducing the above-described high angle grain boundaries into crystal grains at the time of performing cold working, it is desirable to perform cold working after sub-zero treatment is performed. The reason is as follows. The sub-zero treatment has an action of suppressing cross slip of a dislocation during plastic deformation caused by cold working, thus promoting deformation twins.

The present disclosure has been made based on the above-mentioned findings. Hereinafter, requirements of one embodiment of the present disclosure will be described in detail.

1. Chemical Composition

The reasons for limiting respective elements are as follows. In the description made hereinafter, symbol "%" for content refers to "mass %".

C: 0.20% or less

C is an element effective for stabilizing the austenitic phase, and enhances hydrogen embrittlement resistance. However, when C is contained excessively, precipitation of Cr carbides is promoted at the grain boundaries, so that weatherability and hydrogen embrittlement resistance after cold working are lowered. For this reason, a content of C is set to 0.20% or less. The content of C is preferably set to 0.15% or less, and is preferably set to 0.10% or less. In contrast, to obtain the advantageous effects described above, the content of C is preferably set to 0.01% or more.

Si: 2.0% or less

Si is an element effective for deoxidation, and contributes to enhancement of hydrogen embrittlement resistance and to enhancement of strength caused by solid solution strengthening. However, when Si is contained excessively, formation of intermetallic compound, such as a σ phase, is promoted, thus lowering cold workability. For this reason, a content of Si is set to 2.0% or less. The content of Si is preferably set to 1.5% or less, is more preferably set to 1.0% or less, and is further preferably set to 0.8% or less. In contrast, to obtain the advantageous effects described above, the content of Si is preferably set to 0.1% or more.

Mn: 6.0 to 20.0%

Mn is an element that promotes occurrence of deformation twins during and after cold working by stabilizing the austenitic phase, thus contributing to enhancement of strength and hydrogen embrittlement resistance. Mn increases the solubility limit of N, thus indirectly contributing to saving of expensive Ni. For this reason, a content of Mn is set to 6.0% or more. The content of Mn is preferably set to 7.0% or more, and is more preferably set to 8.0% or more. However, when Mn is contained excessively, formation of an ε phase having high hydrogen embrittlement susceptibility is promoted, thus lowering hydrogen embrittlement resistance instead. For this reason, the content of Mn is set to 20.0% or less. The content of Mn is preferably set to 17.0% or less, is more preferably set to 15.0% or less, is further preferably set to 13.0% or less, and is still further preferably set to 10.0% or less.

P: 0.060% or less

P is an element contained in steel as an impurity. However, there may be cases in which P is concentrated at a final step of solidification, thus lowering the melting point of steel, leading to promotion of solidification cracking (high-temperature cracking). Further, there may be cases in which P lowers strength. When a content of P is high and a finish cold rolling ratio, which will be described later, is high, hydrogen embrittlement resistance may be lowered. For this reason, the content of P is set to 0.060% or less. From the viewpoint of improving high-temperature cracking resistance, the content of P is preferably set to 0.030% or less, and is more preferably set to 0.025% or less. In contrast, an excessive reduction of P leads to an increase in manufacturing costs and hence, the content of P is preferably set to 0.005% or more.

S: 0.0080% or less

S is an element contained in steel as an impurity and, in the same manner as P, may promote solidification cracking (high-temperature cracking). For this reason, a content of S is set to 0.0080% or less. The content of S is preferably set to 0.0030% or less, and is more preferably set to 0.0020% or less. However, an excessive reduction of S increases manufacturing costs. For this reason, the content of S is preferably set to 0.0001% or more.

Cr: 10.0 to 18.0%

Cr is an element necessary for stainless steel to enhance corrosion resistance. For this reason, a content of Cr is set to 10.0% or more. The content of Cr is preferably set to 13.0% or more, and is further preferably set to 14.0% or more. However, Cr is an element that forms ferrite. For this reason, when Cr is contained excessively, the austenitic phase is made unstable, so that hydrogen embrittlement resistance is lowered. Further, when Cr is contained excessively, cold workability is also lowered. For this reason, the content of Cr is set to 18.0% or less. The content of Cr is preferably set to 17.0% or less, and is more preferably set to 16.0% or less.

Ni: 4.0 to 12.0%

Ni stabilizes the austenitic phase in the same manner as Mn. Therefore, Ni promotes occurrence of deformation twins during and after cold working, thus increasing strength and enhancing hydrogen embrittlement resistance. For this reason, a content of Ni is set to 4.0% or more. The content of Ni is preferably set to more than 6.0%, is more preferably set to 6.2% or more, and is further preferably set to 6.5% or more. However, when Ni is contained excessively, deformation twins after cold working is suppressed, so that strength and hydrogen embrittlement resistance are lowered. For this reason, the content of Ni is set to 12.0% or less. The content of Ni is preferably set to 10.0% or less, and is more preferably set to 9.0% or less.

N: 0.01 to 0.30%

N stabilizes the austenitic phase in the same manner as Mn and Ni. Therefore, N promotes occurrence of deformation twins during and after cold working, thus increasing strength and enhancing hydrogen embrittlement resistance. For this reason, a content of N is set to 0.01% or more. In the case of positively utilizing the effect of N, the content of N is preferably set to 0.10% or more. However, when N is contained excessively, internal defect, such as a blowhole, may occur, so that hot workability and cold workability, and hydrogen embrittlement resistance are lowered. For this reason, the content of N is set to 0.30% or less. The content of N is preferably set to 0.25% or less.

Cu: 4.0% or less

Cu is an element mixed from raw materials including scrap. Cu stabilizes the austenitic phase, thus enhancing hydrogen embrittlement resistance. In contrast, when Cu is contained excessively, formation of deformation twins after cold working is suppressed in addition to manufacturability, so that strength and hydrogen embrittlement resistance are lowered. For this reason, a content of Cu is set to 4.0% or less. The content of Cu is preferably set to 3.0% or less, is more preferably set to less than 2.3%, and is further preferably set to 1.5% or less. The content of Cu is still further preferably set to less than 1.0%, and is most preferably set to 0.9% or less. However, an excessive reduction of Cu leads to a limitation on a melting raw material, thus increasing manufacturing costs. For this reason, the content of Cu is preferably set to 0.01% or more.

Mo: 3.0% or less

Mo is an element that is mixed from raw materials including scrap, and that is effective for hydrogen embrittlement resistance. However, when Mo is contained excessively, formation of the δ ferrite phase is promoted, so that manufacturability is lowered. Further, when Mo is contained excessively, formation of deformation twins after cold working is suppressed, so that strength and hydrogen embrittlement resistance are lowered. For this reason, a content of Mo is set to 3.0% or less. The content of Mo is preferably set to 2.0% or less, and is further preferably set to 1.0% or less. However, when Mo is contained excessively, a limitation is imposed on a melting raw material, so that manufacturing costs increase. For this reason, the content of Mo is preferably set to 0.01% or more.

In addition to the above-mentioned elements, one or more selected from Al, Ca, B, Mg, Nb, Ti, V, W, Zr, Co, Ga, Hf, and REM may also be contained within the ranges described below. Reasons for limiting the respective elements will be described.

Al: 0 to 0.20%

Al is an element effective for deoxidation. In addition to the above, Al has the effect of suppressing grain boundary segregation of a low melting point element, thus strengthening grain boundaries. As a result, manufacturability and the like are enhanced, and cold workability is improved. For this reason, Al may be contained when necessary. However, when Al is contained excessively, AlN is precipitated, so that manufacturability is lowered instead. Further, when Al is contained excessively, the solubility of N is lowered, so that hydrogen embrittlement resistance is lowered. For this reason, a content of Al is set to 0.20% or less. The content of Al is preferably set to 0.10% or less, and is preferably set to 0.08% or less. In contrast, to obtain the advantageous effects described above, the content of Al is preferably set to 0.01% or more.

Ca: 0 to 0.01%

Ca has the effect of suppressing grain boundary segregation of a low melting point element, thus strengthening grain boundaries. As a result, manufacturability and the like are enhanced, and cold workability is improved. For this reason, Ca may be contained when necessary. However, when Ca is contained excessively, manufacturability and corrosion resistance are lowered instead due to the formation of an inclusion. For this reason, a content of Ca is set to 0.01% or less. The content of Ca is preferably set to 0.005% or less. In contrast, to obtain the advantageous effects described above, the content of Ca is preferably set to 0.001% or more.

B: 0 to 0.01%

B strengthens grain boundaries, thus enhancing strength and enhancing hot workability and cold workability. Therefore, B may be contained when necessary. However, when B is contained excessively, precipitation of boron compound (BN, BC, $Cr_2B$) is promoted at the grain boundaries, so that workability and corrosion resistance are lowered. For this reason, a content of B is set to 0.01% or less. The content of B is preferably set to 0.005% or less. In contrast, to obtain the advantageous effects described above, the content of B is preferably set to 0.0002% or more.

Mg: 0 to 0.01%

Mg is an element having the effect of deoxidation, and has the effect of enhancing manufacturability. Therefore, Mg may be contained when necessary. However, when Mg is contained excessively, manufacturability is lowered in refining or the like, and manufacturing costs increase. For this reason, a content of Mg is set to 0.01% or less. The content of Mg is preferably set to 0.005% or less. In contrast, to obtain the advantageous effects described above, the content of Mg is preferably set to 0.0002% or more, and is more preferably set to 0.0005% or more.

Nb: 0 to 1.0%

Nb forms carbonitrides, thus making crystal grains fine and hence, Nb has the effect of strengthening grain boundaries. As a result, Nb contributes to enhancement of strength. Therefore, Nb may be contained when necessary. However, when Nb is contained excessively, the concentration of solid solution N is lowered, so that hydrogen embrittlement resistance and weatherability are lowered and hot workability and cold workability are lowered. For this reason, a content of Nb is set to 1.0% or less. The content of Nb is preferably set to 0.50% or less. In contrast, to obtain the advantageous effects described above, the content of Nb is preferably set to 0.01% or more.

Ti: 0 to 1.0%

Ti forms carbonitrides, thus making crystal grains fine and hence, Ti has the effect of strengthening grain boundaries. As a result, Ti has the effect of enhancing strength. Therefore, Ti may be contained when necessary. However, when Ti is contained excessively, the concentration of solid solution N is lowered, so that hydrogen embrittlement resistance and weatherability are lowered and hot workability and cold workability are lowered. For this reason, a content of Ti is set to 1.0% or less. The content of Ti is preferably set to 0.50% or less. In contrast, to obtain the advantageous effects described above, the content of Ti is preferably set to 0.01% or more.

V: 0 to 1.0%

V is included in steel in the form of solid solution, or is precipitated as carbonitrides and hence, V has the effect of enhancing strength. Therefore, V may be contained when necessary. However, when V is contained excessively, carbonitrides are formed excessively, so that hot workability and cold workability are lowered. For this reason, a content of V is set to 1.0% or less. The content of V is preferably set to 0.50% or less. In contrast, to obtain the advantageous effects described above, the content of V is preferably set to 0.01% or more.

W: 0 to 2.0%

W has the effect of enhancing strength and weatherability. Therefore, W may be contained when necessary. However, when W is contained excessively, manufacturability and a raw material cost are increases and hence, a content of W is set to 2.0% or less. The content of W is preferably set to 1.0% or less. In contrast, to obtain the advantageous effects described above, the content of W is preferably set to 0.01% or more.

Zr: 0 to 1.0%

Zr has the effect of deoxidation. Further, Zr has the effect of enhancing weatherability. Therefore, Zr may be contained when necessary. However, when Zr is contained excessively, toughness and workability are lowered. For this reason, a content of Zr is set to 1.0% or less. The content of Zr is preferably set to 0.50% or less. In contrast, to obtain the advantageous effects described above, the content of Zr is preferably set to 0.01% or more.

Co: 0 to 2.0%

Co has the effect of enhancing corrosion resistance, thus stabilizing the austenitic phase. Therefore, Co may be contained when necessary. However, when Co is contained excessively, manufacturing costs increase and hence, a content of Co is set to 2.0% or less. The content of Co is preferably set to 1.0% or less. In contrast, to obtain the advantageous effects described above, the content of Co is preferably set to 0.01% or more.

Ga: 0 to 0.10%

Ga has the effect of enhancing hot workability. Therefore, Ga may be contained when necessary. However, when Ga is contained excessively, manufacturability is lowered. For this reason, a content of Ga is set to 0.10% or less. The content of Ga is preferably set to 0.05% or less. In contrast, to obtain the advantageous effects described above, the content of Ga is preferably set to 0.01% or more.

Hf: 0 to 0.10%

Hf has the effect of deoxidation, and has the effect of enhancing weldability. Therefore, Hf may be contained when necessary. However, when Hf is contained excessively, manufacturability is lowered in refining or the like. For this reason, a content of Hf is set to 0.10% or less. The content of Hf is preferably set to 0.05% or less. In contrast, to obtain the advantageous effects described above, the content of Hf is preferably set to 0.01% or more.

REM: 0 to 0.10%

REM has the effect of deoxidation, and has the effect of enhancing manufacturability. REM also has the effect of enhancing corrosion resistance. Therefore, REM may be contained when necessary. However, when REM is contained excessively, not only that the effect of REM is saturated, but also that manufacturability is lowered instead in refining or the like. For this reason, a content of REM is set to 0.10% or less. The content of REM is preferably set to 0.05% or less. In contrast, to obtain the advantageous effects described above, the content of REM is preferably set to 0.01% or more.

REM refers to a total of seventeen elements including Sc, Y, and lanthanoids, and the content of REM means a total content of these elements. Industrially, REM is often added in the form of misch metal.

In the chemical composition in the present embodiment, the balance consists of Fe and impurities. In the present embodiment, the term "impurities" means components which are mixed into an austenitic stainless steel material due to various causes, such as a raw material including ore or scrap, or production steps, in industrially producing the austenitic stainless steel material, and which are allowed within a range where the impurities do not adversely affect the present embodiment.

A Value

In the chemical composition of the steel material of the present embodiment, an A value, which is an index for stability of the austenitic phase and is also an index for plastic deformation mechanism, is set to 30.0 to 60.0. The A value is calculated by a formula (i) described below.

$$A\ value=3.2Mn+0.7Cr+6.2Ni+38.7N+4.8Cu+9.3Mo-53 \quad (i)$$

where respective element symbols in the formula (i) denote contents (mass %) of the respective elements contained in steel, and 0 is given when the element is not contained.

When the A value is less than 30.0, the austenitic phase has low stability, and strain-induced martensite is formed. Therefore, not only crystal grains having a face centered cubic (fcc) crystal structure, but also crystal grains having a body centered cubic (bcc) crystal structure increase, so that hydrogen embrittlement resistance is lowered. For this reason, the A value is set to 30.0 or more. From the viewpoint of hydrogen embrittlement resistance, the A value is preferably set to 32.0 or more, and is more preferably set to 35.0 or more.

However, when the A value exceeds 60.0, occurrence of deformation twins after cold working is suppressed, so that strength and elongation are lowered in a high pressure hydrogen gas environment. As a result, hydrogen embrittlement resistance is lowered. Further, a raw material cost is increased, and manufacturability may be lowered. For this reason, the A value is set to 60.0 or less. From the viewpoint of strength after cold working, economic efficiency, and manufacturability, the A value is preferably set to 50.0 or less.

2. Proportion of High Angle Grain Boundaries

In the austenitic stainless steel material of the present embodiment, the proportion of high angle grain boundaries in a metallurgical structure is set to the following range, the high angle grain boundaries affecting twinning deformation. Specifically, in the metallurgical structure of a surface layer, a proportion of high angle grain boundaries Gs satisfies a formula (ii) described below. The high angle grain boundary in the present embodiment refers to a grain boundary with a misorientation with respect to the orientation inside the crystal grain falling within a range of 15 to 60°.

$$0.1<Gs<0.6 \quad (ii)$$

A symbol in the formula described above is defined as follows.

Gs: proportion of high angle grain boundaries

When the Gs is 0.1 or less, formation of deformation twins that uses the high angle grain boundaries as starting points cannot be promoted after cold working. As a result, in a high pressure hydrogen gas environment, strength and elongation are lowered, so that hydrogen embrittlement resistance is lowered. For this reason, the Gs is set to more than 0.1. From the viewpoint of high strength and hydrogen embrittlement resistance after cold working, the Gs is preferably set to 0.20 or more, and is more preferably set to 0.30 or more. In contrast, when the Gs is 0.6 or more, occurrence of deformation twins is suppressed instead after cold working. As a result, strength and elongation are lowered in a high pressure hydrogen gas environment. Further, after cold working is performed, formation of deformation-induced martensite that uses high angle grain boundaries as the starting points is induced, so that such Gs also leads to lowering of hydrogen embrittlement resistance. For this reason, the Gs is set to less than 0.6. From the viewpoint of high strength and hydrogen embrittlement resistance after cold working, the Gs is preferably set to 0.5 or less.

The Gs can be measured by a crystal orientation analysis system that uses an EBSP. Specifically, the total thickness of the steel material in the direction perpendicular to a cold working surface (rolling surface) is assumed as "t", one surface parallel to the working surface (rolling surface) is selected within a range from the surface of the steel to a position of t/4, and the selected surface is mirror-finished. It is preferable that the mirror-finished surface be used as the observation surface, and the EBSP be measured by glow discharge optical emission spectrometry (GDS). It is sufficient to perform measurement on a surface that is at a position of t/8, for example, and that is parallel to the working surface (rolling surface).

For example, in the case of performing measurement on the surface that is at the position of t/8 and that is parallel to the working surface (rolling surface), it is preferable to set conditions for GDS such that a pulse sputtering mode is adopted in which an output is 20 W and a pressure is 600 Pa and such that a sputter depth is set to 0.1 μm or less. By using GDS, it is also possible to maintain accuracy in measuring the EBSP even in a steel material that is subjected to cold working. For the measurement of the EBSP, it is preferable to cover a region of 45 μm×130 μm. In performing measurement, it is preferable to set observation magnification to 2000, and it is sufficient that the Gs satisfy the range in the present embodiment in at least one field of view. The Gs can be calculated by the area fraction method in which a misorientation with respect to the orientation in the crystal grain is set to 15 to 60° in a grain boundary map display of the crystal orientation analysis system. It is desirable to adopt, for the Gs, a numerical value from an observation field of view in which the average value of CI values (confidence indexes) is more than 0.2.

3. Vickers Hardness

Hardness of the austenitic stainless steel material of the present embodiment is increased when work hardened. For this reason, Vickers hardness is preferably set to 250 to 500 HV1. When the Vickers hardness is less than 250 HV1, desired strength of 800 MPa or more is less likely to be obtained. For this reason, the Vickers hardness is preferably set to 250 HV1 or more. From the viewpoint of strength and hydrogen embrittlement, the Vickers hardness is more preferably set to 300 HV1. In contrast, when the Vickers hardness exceeds 500, tensile strength is likely to exceed 1700 MPa, so that elongation itself of a material is remarkably lowered. As a result, it becomes difficult to maintain elongation in a high pressure hydrogen gas environment.

When strain-induced martensite (body centered cubic: bcc) is formed in plastic deformation during and after cold working, so that the proportion of the austenitic phase (face centered cubic: fcc) is reduced, hydrogen embrittlement resistance is lowered. For this reason, the Vickers hardness is preferably set to 500 HV1 or less. From the viewpoint of hydrogen embrittlement resistance, the Vickers hardness is more preferably set to 450 HV1 or less.

It is sufficient to measure the Vickers hardness under the following conditions in accordance with JIS Z 2244: 2020. Specifically, it is sufficient to prepare a resin embedded specimen of a cross section, to set a load to 1 kg (9.8 N) at the position in the vicinity of t/2, and to measure the Vickers hardness by a Vickers hardness tester. It is sufficient to apply a test force for the duration of 20 seconds.

4. Crystal Structure

In the austenitic stainless steel material of the present embodiment, to suppress lowering of hydrogen embrittlement resistance, it is desirable to suppress formation of strain-induced martensite after working is performed. For this reason, it is preferable that the crystal structure has, in an area ratio, 97% or more of an fcc structure.

The fact that the area ratio of crystal grains having the fee structure is less than 97% indicates that a large amount of S ferrite and strain-induced martensite having the bcc structure are formed and hence, such a structure is not desirable from the viewpoint of hydrogen embrittlement resistance. For this reason, it is preferable that 97% or more of the crystal structure have the fcc structure in an area ratio. Note that although 6 ferrite may be partially formed or may be inevitably formed, even in such a case, when the area ratio of crystal grains having the bcc structure is less than 3%, 8 ferrite only has a small influence on hydrogen embrittlement resistance and hence, S ferrite may be allowed.

It is sufficient to measure the crystal structure by the following procedure. Specifically, it is sufficient to perform X-ray diffraction on the above-described EBSP measurement surface to calculate the area ratio of grains having the fcc structure and the area ratio of grains having the bcc structure. It is sufficient to set conditions for X-ray diffraction such that CuKα radiation is used, an applied voltage is set to 40 kv, and 2θ is set to a value which falls within a range of 30°≤2θ≤90°.

5. Application

It is desirable to use the austenitic stainless steel material of the present embodiment for a device for hydrogen that is required to reduce a weight and to achieve a compact shape in order to increase strength in a high-pressure hydrogen environment. Examples of the device for hydrogen include the body of a tank that stores hydrogen gas and liquid hydrogen, the mouthpiece of the tank, a liner, a pipe forming a flow passage for hydrogen gas, a valve, and a heat exchanger.

6. Production Method

A preferable method for producing the austenitic stainless steel material of the present embodiment will be described. The austenitic stainless steel material of the present embodiment can obtain effects irrespective of a production method provided that the austenitic stainless steel material of the present embodiment has the configuration described above. The austenitic stainless steel material of the present embodiment can be stably produced by the following production method, for example.

In the description made hereinafter, for the sake of simplification, the description will be made assuming that the shape of the steel material is a sheet shape. However, the shape of the steel material is not particularly limited. For example, a plate shape, a rod shape, or a tubular shape may be considered. It is sufficient to select a working method that corresponds to each shape.

Steel that is adjusted to have the chemical composition described above is melted and casted by conventional methods to obtain a steel slab to be subjected to hot rolling. Subsequently, hot rolling is performed by a conventional method. Although conditions for the hot rolling are not particularly limited, usually, it is preferable that a heating temperature of the steel slab be set to 1050 to 1250° C. and a rolling ratio fall within a range from 20 to 99%. After the hot rolling is performed, annealing and pickling may be performed when necessary. Although an annealing temperature for the annealing is not particularly limited, it is sufficient to set the annealing temperature to a value which falls within a range from 1050 to 1100° C., for example.

Then, cold rolling and annealing are performed when necessary. Annealing performed immediately before final finish cold rolling is referred to as "solution treatment", and the solution treatment is performed in the same manner. Pickling is also performed when necessary. It is preferable to perform the cold rolling within a rolling ratio range of 20 to 90%, for example and, thereafter, to perform annealing such that isothermal holding is performed at 1000 to 1150° C. for 1 to 600 seconds. The cold rolling, the annealing, and the pickling may be repeated a plurality of times in order to obtain a steel material having a required final thickness.

The solution treatment is performed immediately before the final finish cold rolling which is performed to cause work hardening. In the solution treatment, it is preferable to perform heat treatment under the condition of the isothermal holding being performed at 1000 to 1150° C. for 1 to 600 seconds. When a solution treatment temperature is less than 1000° C., recrystallization is insufficient, so that a sufficient amount of high angle grain boundaries is not introduced by twinning deformation during the final finish cold rolling and hence, it becomes difficult for the Gs to satisfy the formula (ii). For this reason, the solution treatment temperature is preferably set to 1000° C. or more. In contrast, when the solution treatment temperature exceeds 1150° C., crystal grains are coarsened (more than 0.1 mm) and hence, it becomes difficult for the Gs to satisfy the formula (ii) after the cold working is performed in the same manner as the above. For this reason, the solution treatment temperature is preferably set to 1150° C. or less.

By further performing sub-zero treatment immediately after the solution treatment, it is possible to introduce high angle grain boundaries effectively and efficiently in crystal grains at the time of performing the final finish cold rolling, which is performed after the sub-zero treatment, and hence, it is possible to increase the value of the Gs. For this reason, it is preferable to perform the sub-zero treatment. The sub-zero treatment refers to quenching treatment in which components are rapidly cooled from the solution treatment temperature to 0° C. or less. It is preferable to perform rapid-cooling in accordance with HSZ specified by JIS standards by a liquid method or a gas method, in which dry ice, liquid nitrogen, or a carbon dioxide gas is used as freezing mixture.

Lastly, the final finish cold rolling is performed to obtain a work-hardened steel material. By performing the final finish cold rolling after the solution treatment or after the sub-zero treatment, which is performed after the solution treatment, it is possible to increase the value of the Gs, thus obtaining preferable strength. For this reason, it is preferable to perform the final finish cold rolling within a rolling ratio range of 10 to 80% after the solution treatment or after the sub-zero treatment. The reason is as follows. When the rolling ratio is less than 10%, sufficient hardness and sufficient strength cannot be obtained. In addition to the above, the value of the Gs is less likely to be increased. For this reason, a final finish cold rolling ratio is preferably set to 10% or more.

In contrast, when the rolling ratio exceeds 80%, strength is excessively increased, so that hydrogen embrittlement resistance is lowered. In addition to the above, a desired value of the Gs is less likely to be obtained. For this reason, the final finish cold rolling ratio is preferably set to 80% or less. To cause hardness to fall within a range from 300 to 450 HV1, the final finish cold rolling ratio is preferably set to a value which falls within a range from 20 to 70%. Although the description has been made by taking a steel sheet as an example, in the case of a steel material having a rod shape or a tubular shape, for example, it is sufficient to set a reduction in area to a value which falls within a range from 10 to 80%. That is, it is sufficient to perform adjustment such that a cold working ratio falls within the range from 10 to 80%. Further, it is sufficient to perform control such that the metallurgical structures form austenitic stainless steel by adjusting conditions of the above-mentioned ranges and other conditions.

Hereinafter, the austenitic stainless steel material of the present embodiment will be more specifically described with reference to examples. However, the present embodiment is not limited to such examples.

Example

Each of slabs having the compositions shown in Table 1 was melted, was heated to 1200° C. and, thereafter, was hot-rolled to obtain a hot rolled sheet having a thickness of 5.0 mm. Next, the hot rolled sheet was subjected to annealing at 1050 to 1100° C. and to pickling and, thereafter, was cold rolled to a thickness of 2 mm to obtain a cold rolled sheet. Then, the cold rolled sheet was subjected to solution treatment at 1050 to 1100° C. for 30 seconds and, thereafter, was subjected to pickling. Some steel sheets were subjected to sub-zero treatment. In the sub-zero treatment, the steel sheet was rapidly cooled from a solution treatment temperature to −10° C. by the above-described liquid method by using dry ice and ethanol as freezing mixture. Thereafter, irrespective of the sub-zero treatment being performed or not, the obtained steel sheet was subjected to final finish cold rolling within a range of 10 to 80% to obtain a specimen (austenitic stainless steel sheet) having a thickness of 0.4 to 1.8 mm.

[Table 1]

TABLE 1

| Steel type | Chemical composition (mass %, balance: Fe and impurities) | | | | | | | | | | | |
|---|---|---|---|---|---|---|---|---|---|---|---|---|
| | C | Si | Mn | P | S | Cr | Ni | N | Cu | Mo | Al | Ca |
| A1 | 0.061 | 0.54 | 9.3 | 0.015 | 0.0003 | 15.1 | 7.3 | 0.175 | 0.02 | 0.01 | 0.022 | 0.0028 |
| A2 | 0.145 | 0.65 | 8.1 | 0.014 | 0.0005 | 15.4 | 6.7 | 0.150 | 0.003 | 0.004 | — | — |
| A3 | 0.035 | 1.22 | 9.7 | 0.023 | 0.0001 | 12.8 | 10.5 | 0.130 | 0.11 | 0.21 | 0.055 | — |
| A4 | 0.011 | 0.11 | 15.2 | 0.006 | 0.0002 | 17.8 | 4.3 | 0.290 | 0.05 | 0.08 | — | 0.0033 |
| A5 | 0.062 | 0.52 | 9.2 | 0.051 | 0.0015 | 15.5 | 6.8 | 0.015 | 2.25 | 0.35 | — | — |
| A6 | 0.045 | 0.45 | 6.5 | 0.019 | 0.0035 | 14.8 | 7.1 | 0.105 | 0.51 | 2.50 | — | — |
| A7 | 0.205 * | 0.53 | 8.1 | 0.016 | 0.0005 | 15.7 | 7.3 | 0.165 | 0.11 | 0.05 | 0.021 | 0.0021 |
| A8 | 0.066 | 0.55 | 9.1 | 0.019 | 0.0004 | 17.5 | 7.2 | 0.305 * | 0.12 | 0.06 | 0.026 | — |
| A9 | 0.077 | 0.50 | 8.9 | 0.022 | 0.0002 | 18.2 * | 7.5 | 0.155 | 0.11 | 0.07 | 0.020 | 0.0027 |
| A10 | 0.061 | 0.48 | 6.8 | 0.019 | 0.0003 | 15.2 | 12.2 * | 0.030 | 0.08 | 0.08 | 0.033 | 0.0011 |
| A11 | 0.050 | 0.59 | 7.5 | 0.018 | 0.0004 | 15.3 | 6.7 | 0.175 | 4.05 * | 0.06 | 0.035 | 0.0025 |
| A12 | 0.055 | 0.53 | 7.2 | 0.021 | 0.0003 | 15.3 | 6.8 | 0.145 | 0.05 | 3.05 * | 0.020 | 0.0031 |
| A13 | 0.061 | 0.48 | 8.1 | 0.019 | 0.0005 | 16.3 | 6.2 | 0.155 | 0.12 | 0.05 | 0.031 | 0.0023 |
| A14 | 0.051 | 0.57 | 9.8 | 0.021 | 0.0003 | 17.2 | 10.1 | 0.155 | 0.11 | 0.07 | 0.042 | 0.0002 |

| Steel type | Chemical composition (mass %, balance: Fe and impurities) | | | | | | | | | | | A value† |
|---|---|---|---|---|---|---|---|---|---|---|---|---|
| | B | Mg | Nb | Ti | V | W | Zr | Co | Ga | Hf | REM | |
| A1 | 0.0003 | 0.0002 | 0.01 | 0.01 | 0.12 | 0.03 | — | — | — | — | — | 39.6 |
| A2 | — | — | — | — | — | — | — | — | — | — | — | 31.0 |
| A3 | 0.0085 | — | — | — | — | — | 0.35 | 0.45 | 0.05 | 0.09 | — | 59.6 |
| A4 | — | — | — | — | — | 0.55 | — | — | — | — | 0.10 | 47.0 |
| A5 | 0.0015 | 0.0090 | 0.45 | — | 0.12 | — | — | — | — | — | — | 44.1 |

TABLE 1-continued

| | | | | | | | | | | | | |
|---|---|---|---|---|---|---|---|---|---|---|---|---|
| A6 | — | — | — | 0.25 | 0.45 | — | 0.01 | 0.09 | — | — | — | 51.9 |
| A7 | 0.0006 | — | — | — | — | — | — | — | — | — | — | 36.5 |
| A8 | 0.0007 | — | — | — | — | — | — | — | — | — | — | 45.9 |
| A9 | 0.0007 | — | — | — | — | — | — | — | — | — | — | 41.9 |
| A10 | 0.0006 | — | — | — | — | — | — | — | — | — | — | 57.3 |
| A11 | 0.0005 | — | — | — | — | — | — | — | — | — | — | 50.0 |
| A12 | 0.0005 | — | — | — | — | — | — | — | — | — | — | 57.1 |
| A13 | 0.0010 | — | — | — | — | — | — | — | — | — | — | 29.8 * |
| A14 | — | — | — | — | — | — | — | — | — | — | — | 60.2 * |

†A value = 3.2Mn + 0.7Cr + 6.2Ni + 38.7N + 4.8Cu + 9.3Mo − 53

* indicates that the preferable does not satisfy the requirement of the chemical composition in the present embodiment The obtained specimens were examined for calculation of Gs, hardness, and crystal structure, and were evaluated for hydrogen embrittlement resistance by the following procedure.

(Calculation of Gs)

Next, each specimen was adjusted by the above-described method on the surface that was at the position of t/8 and that was parallel to the rolling surface to obtain Gs by an EBSP crystal orientation analysis system. Observation magnification of EBSP was set to 2000, and a numerical value obtained from the field of view of CI value≥0.2 was used as the Gs. The Gs was measured under the conditions described above.

(Measurement of Hardness)

A resin embedded specimen of the cross section of each specimen was prepared, a load was set to 1 kg (9.8 N) at the position in the vicinity of t/2, and a hardness test was performed in accordance with JIS Z 2244: 2020. In the test, a Vickers hardness tester was used, and the duration of the test force was set to 20 seconds.

(Identification of Crystal Structure)

Regarding the crystal structure, X-ray diffraction was performed on an EBSP measurement surface to calculate the area ratio of grains having the fee structure and the area ratio of grains having the bcc structure. Conditions for the X-ray diffraction were set such that CuKα radiation was used, an applied voltage was set to 40 kv, and 2θ was set to a value which fell within a range of 30°≤2θ≤90°. In the results shown in Table 2, "present" was given to the specimen in which the area ratio of crystal grains having the bcc structure was more than 3%.

(Evaluation of Hydrogen Embrittlement Resistance)

Hydrogen embrittlement resistance was measured by the following procedure. A parallel portion of 4 mm width×20 mm length was sampled as a tensile test piece. Subsequently, a slow strain rate test (hereinafter, referred to as "SSRT test") with a strain rate of 10'/s was performed on the above-mentioned tensile test piece in 70 MPa hydrogen and in 0.1 MPa nitrogen at −40° C. In the SSRT test, evaluation was made by measuring tensile fracture strength and tensile fracture elongation. Specifically, hydrogen embrittlement resistance was evaluated by using a numerical value calculated by the formula described below.

Hydrogen embrittlement resistance evaluation value based on tensile fracture strength=(tensile fracture strength in 70 MPa hydrogen)/(tensile fracture strength in 0.1 MPa nitrogen)×100(%) (a)

Hydrogen embrittlement resistance evaluation value based on tensile fracture elongation=(tensile fracture elongation in 70 MPa hydrogen)/(tensile fracture elongation in 0.1 MPa nitrogen)×100(%) (b)

In the case in which hydrogen embrittlement resistance evaluation value based on tensile fracture strength calculated by the above-mentioned formula was 95% or more and hydrogen embrittlement resistance evaluation value based on tensile fracture elongation was 85% or more, the test piece was considered to have preferable hydrogen embrittlement resistance, so that "good" was given. In contrast, in the case in which hydrogen embrittlement resistance evaluation value did not reach the above-mentioned numerical value, the test piece was considered to have bad hydrogen embrittlement resistance, so that "bad" was given. Further, in the case in which hydrogen embrittlement resistance evaluation value based on tensile fracture strength was 95% or more and hydrogen embrittlement resistance evaluation value based on tensile fracture elongation was 100% or more, the test piece was considered to have particularly excellent hydrogen embrittlement resistance, so that "excellent" was given. Hereinafter, the results are collectively shown in Table 2.

[Table 2]

TABLE 2

| | | Production method | | | Physical properties | | | Characteristic evaluation | |
|---|---|---|---|---|---|---|---|---|---|
| No | Steel type | Solution treatment | Sub-zero treatment | Finish cold rolling ratio (%) | Proportion of high angle grain boundaries Gs | Vickers hardness HV (9.8N) | Crystal structure Presence or absence of bcc | Determination of evaluation value for hydrogen embrittlement resistance | |
| 1 | A1 | Performed | Not-performed | 20 | 0.21 | 310 | Not present | Excellent | Inventive Example of Present Invention |
| 2 | | | Performed | | 0.23 | 315 | Not present | Excellent | |
| 3 | | | Not-performed | 70 | 0.41 | 430 | Not present | Excellent | |
| 4 | | | Performed | | 0.46 | 435 | Not present | Excellent | |
| 5 | A2 | | Performed | 60 | 0.35 | 415 | Present ** | Good | |
| 6 | A3 | | Not-performed | 40 | 0.28 | 370 | Not present | Good | |
| 7 | | | Performed | | 0.32 | 380 | Not present | Excellent | |
| 8 | A4 | | Not-performed | 10 | 0.18 | 300 | Not present | Good | |

TABLE 2-continued

| No | Steel type | Production method: Solution treatment | Production method: Sub-zero treatment | Production method: Finish cold rolling ratio (%) | Physical properties: Proportion of high angle grain boundaries Gs | Physical properties: Vickers hardness HV (9.8N) | Physical properties: Crystal structure Presence or absence of bcc | Characteristic evaluation: Determination of evaluation value for hydrogen embrittlement resistance | |
|---|---|---|---|---|---|---|---|---|---|
| 9 | A5 | | Not-performed | 15 | 0.15 | 230 ** | Not present | Excellent | |
| 10 | | | Not-performed | 70 | 0.35 | 360 | Not present | Good | |
| 11 | | | Performed | | 0.42 | 380 | Not present | Excellent | |
| 12 | A6 | | Performed | 60 | 0.40 | 420 | Not present | Excellent | |
| 13 | A7 * | Performed | Performed | 60 | 0.63 * | 430 | Present ** | Bad | Comparative Example |
| 14 | A8 * | | Performed | 60 | 0.65 * | 480 | Not present | Bad | |
| 15 | A9 * | | Performed | 60 | 0.45 | 400 | Not present | Bad | |
| 16 | A10 * | | Performed | 60 | 0.42 | 380 | Not present | Bad | |
| 17 | A11 * | | Performed | 60 | 0.36 | 360 | Not present | Bad | |
| 18 | A12 * | | Performed | 60 | 0.41 | 440 | Not present | Bad | |
| 19 | A13 * | | Performed | 60 | 0.45 | 450 | Present ** | Bad | |
| 20 | A14 * | | Performed | 60 | 0.38 | 380 | Not present | Bad | |
| 21 | A1 | | Performed | 85 | 0.65 * | 505 ** | Not present | Bad | |
| 22 | A1 | | Performed | 5 | 0.05 * | 210 ** | Not present | Bad | |

* indicates that the specimen does not satisfy the requirement in the present embodiment

** indicates that the specimen falls outside the preferable range in the present embodiment Underline: indicates that the specimen does not satisfy the preferable production condition or preferable property in the present embodiment The specimens No. 1 to 12 that satisfied the chemical composition, the A value, and the Gs in the present embodiment could obtain the target hydrogen embrittlement resistance. Particularly in No. 1 to 4, 7, 11, and 12, preferable hardness and a preferable crystal structure in the present embodiment were achieved, and "excellent", which meant that the specimen was particularly excellent in the characteristic, was given for hydrogen embrittlement resistance. No. 1 to 4, in which "excellent" was given for hydrogen embrittlement resistance, satisfied the preferable ranges in the present embodiment for the chemical composition and the A value. Although No. 7, 11, and 12 did not satisfy the preferable ranges in the present embodiment for the chemical composition and the A value, sub-zero treatment increased the Gs, so that hydrogen embrittlement resistance was enhanced and "excellent" was given for hydrogen embrittlement resistance. Although No. 9 had a relatively high content of P, thus not satisfying the preferable chemical composition in the present embodiment, No. 9 had a low finish cold rolling ratio. Therefore, in No. 9, hydrogen embrittlement resistance retained "excellent", but hardness was lowered. No. 10 had a relatively high content of P in the same manner as No. 9, and had a high finish cold rolling ratio. Therefore, in No. 10, hardness was increased, but "good" was given for hydrogen embrittlement resistance.

In contrast, No. 13 to 18 did not satisfy the requirements in the present embodiment with respect to chemical composition, and No. 19 and 20 did not satisfy the requirements in the present embodiment with respect to the chemical composition, especially, the A value. Therefore, even when sub-zero treatment was performed, hydrogen embrittlement resistance was lowered. No. 21 and No. 22 did not satisfy a preferable range of a finish cold rolling ratio and hence, the value of the Gs was excessively increased or lowered, and hydrogen embrittlement resistance was also lowered.

APPENDIX (1) An austenitic stainless steel material, wherein a chemical composition includes, in mass %:

C: 0.20% or less;

Si: 2.0% or less;

Mn: 6.0 to 20.0%;

P: 0.060% or less;

S: 0.0080% or less;

Cr: 10.0 to 18.0%;

Ni: 4.0 to 12.0%;

N: 0.01 to 0.30%;

Cu: 4.0% or less;

Mo: 3.0% or less;

Al: 0 to 0.20%;

Ca: 0 to 0.01%;

B: 0 to 0.01%;

Mg: 0 to 0.01%;

Nb: 0 to 1.0%;

Ti: 0 to 1.0%;

V: 0 to 1.0%;

W: 0 to 2.0%;

Zr: 0 to 1.0%;

Co: 0 to 2.0%;

Ga: 0 to 0.10%;

Hf: 0 to 0.10%;

REM: 0 to 0.10%; and the balance: Fe and impurity, an A value calculated by a formula (i) described below is 30.0 to 60.0, and in a metallurgical structure of a surface layer, a proportion Gs of high angle grain boundaries satisfies a formula (ii) described below:

$$\text{A value}=3.2Mn+0.7Cr+6.2Ni+38.7N+4.8Cu+9.3Mo-53 \quad \text{(i)}$$

$$0.1<Gs<0.6 \quad \text{(ii)}$$

where element symbols in the formula (i) denote contents (mass %) of the elements contained in steel, 0 is given when the element is not contained, and a symbol in the formula described above is defined as follows:

Gs: proportion of high angle grain boundaries.

(2) The austenitic stainless steel material according to (1) above, wherein

Vickers hardness is 250 to 500 HV1, and a crystal structure has, in an area ratio, 97% or more of an fee structure.

(3) The austenitic stainless steel material according to (1) or (2) above, wherein the chemical composition contains, in mass %, one or more elements selected from Al: 0.01 to 0.20%,
Ca: 0.001 to 0.01%,
B: 0.0002 to 0.01%,
Mg: 0.0002 to 0.01%,
Nb: 0.01 to 1.0%,
Ti: 0.01 to 1.0%,
V: 0.01 to 1.0%,
W: 0.01 to 2.0%,
Zr: 0.01 to 1.0%,
Co: 0.01 to 2.0%,
Ga: 0.01 to 0.10%,
Hf: 0.01 to 0.10%, and
REM: 0.01 to 0.10%.

(4) The austenitic stainless steel material according to any one of (1) to (3) above, wherein the austenitic stainless steel material is used in a high pressure hydrogen gas environment.

(5) A method for producing the austenitic stainless steel material according to any one of (1) to (4) above, wherein the method includes:

a step of performing solution treatment;
a step of performing sub-zero treatment; and
a step of performing cold working.

(6) A device for hydrogen including the austenitic stainless steel material according to any one of (1) to (4) above.

(7) The device for hydrogen described in the above-mentioned (6), wherein the device for hydrogen is a body of a tank, a mouthpiece of the tank, a liner, a pipe, a valve, or a heat exchanger.

INDUSTRIAL APPLICABILITY

The austenitic stainless steel material of the present embodiment has both high strength and hydrogen embrittlement resistance, thus being preferably used for a steel sheet, a rod, or a tube that is used in a high pressure hydrogen gas environment after cold working is performed. It is desirable to use the austenitic stainless steel material of the present embodiment for a device for hydrogen that is required to reduce a weight and to achieve a compact shape by increasing strength. The steel material of the present embodiment can contribute to an increase in strength caused by cold working and to a reduction in thickness and weight of the device for hydrogen and parts caused by an increase in strength.

The invention claimed is:

1. An austenitic stainless steel material, wherein a chemical composition comprises, in mass %:

C: 0.20% or less;
Si: 2.0% or less;
Mn: 6.0 to 20.0%;
P: 0.060% or less;
S: 0.0080% or less;
Cr: 10.0 to 18.0%;
Ni: 4.0 to 12.0%;
N: 0.01 to 0.30%;
Cu: 4.0% or less;
Mo: 3.0% or less;
Al: 0 to 0.20%;
Ca: 0 to 0.01%;
B: 0 to 0.01%;
Mg: 0 to 0.01%;
Nb: 0 to 1.0%;
Ti: 0 to 1.0%;
V: 0 to 1.0%;
W: 0 to 2.0%;
Zr: 0 to 1.0%;
Co: 0 to 2.0%;
Ga: 0 to 0.10%;
Hf: 0 to 0.10%;
REM: 0 to 0.10%; and
the balance: Fe and impurity, an A value calculated by a formula (i) described below is 30.0 to 60.0, and in a metallurgical structure of a surface layer, a proportion Gs of high angle grain boundaries satisfies a formula (ii) described below:

$$\text{A value}=3.2Mn+0.7Cr+6.2Ni+38.7N+4.8Cu+9.3Mo-53 \quad \text{(i)}$$

$$0.1<Gs<0.6 \quad \text{(ii)}$$

where element symbols in the formula (i) denote contents (mass %) of the elements contained in steel, 0 is given when the element is not contained, and a symbol in the formula described above is defined as follows:

Gs: proportion of high angle grain boundaries.

2. The austenitic stainless steel material according to claim 1, wherein Vickers hardness is 250 to 500 HV1, and a crystal structure has, in an area ratio, 97% or more of an fcc structure.

3. The austenitic stainless steel material according to claim 1, wherein the chemical composition contains, in mass %, one or more elements selected from Al: 0.01 to 0.20%,
Ca: 0.001 to 0.01%,
B: 0.0002 to 0.01%,
Mg: 0.0002 to 0.01%,
Nb: 0.01 to 1.0%,
Ti: 0.01 to 1.0%,
V: 0.01 to 1.0%,
W: 0.01 to 2.0%,
Zr: 0.01 to 1.0%,
Co: 0.01 to 2.0%,
Ga: 0.01 to 0.10%,
Hf: 0.01 to 0.10%, and
REM: 0.01 to 0.10%.

4. The austenitic stainless steel material according to claim 2, wherein the chemical composition contains, in mass %, one or more elements selected from Al: 0.01 to 0.20%,
Ca: 0.001 to 0.01%,
B: 0.0002 to 0.01%,
Mg: 0.0002 to 0.01%,
Nb: 0.01 to 1.0%,
Ti: 0.01 to 1.0%,
V: 0.01 to 1.0%,
W: 0.01 to 2.0%,
Zr: 0.01 to 1.0%,
Co: 0.01 to 2.0%,
Ga: 0.01 to 0.10%,
Hf: 0.01 to 0.10%, and
REM: 0.01 to 0.10%.

5. The austenitic stainless steel material according to claim 1, wherein the austenitic stainless steel material is used in a high pressure hydrogen gas environment.

6. The austenitic stainless steel material according to claim 2, wherein the austenitic stainless steel material is used in a high pressure hydrogen gas environment.

7. The austenitic stainless steel material according to claim 3, wherein the austenitic stainless steel material is used in a high pressure hydrogen gas environment.

8. The austenitic stainless steel material according to claim 4, wherein the austenitic stainless steel material is used in a high pressure hydrogen gas environment.

9. A device for hydrogen comprising the austenitic stainless steel material according to claim 1.

10. The device for hydrogen according to claim 9, wherein the device for hydrogen is a body of a tank, a mouthpiece of the tank, a liner, a pipe, a valve, or a heat exchanger.

11. A device for hydrogen comprising the austenitic stainless steel material according to claim 2.

12. The device for hydrogen according to claim 11, wherein the device for hydrogen is a body of a tank, a mouthpiece of the tank, a liner, a pipe, a valve, or a heat exchanger.

13. A device for hydrogen comprising the austenitic stainless steel material according to claim 3.

14. The device for hydrogen according to claim 13, wherein the device for hydrogen is a body of a tank, a mouthpiece of the tank, a liner, a pipe, a valve, or a heat exchanger.

15. A device for hydrogen comprising the austenitic stainless steel material according to claim 4.

16. A device for hydrogen comprising the austenitic stainless steel material according to claim 5.

17. A device for hydrogen comprising the austenitic stainless steel material according to claim 6.

18. A device for hydrogen comprising the austenitic stainless steel material according to claim 7.

19. A device for hydrogen comprising the austenitic stainless steel material according to claim 8.

20. A method for producing the austenitic stainless steel material according to claim 1, wherein the method comprises:

performing solution treatment;

performing sub-zero treatment; and performing cold working.

* * * * *